United States Patent [19]

Stiglich

[11] Patent Number: 4,779,539

[45] Date of Patent: Oct. 25, 1988

[54] WALL-MOUNTABLE FOLDING TABLE

[75] Inventor: Nicholas M. Stiglich, Cresskill, N.J.

[73] Assignee: Marta Mooney, New York, N.Y.

[21] Appl. No.: 874,276

[22] Filed: Jun. 13, 1986

[51] Int. Cl.[4] ..... A47B 5/00

[52] U.S. Cl. ..... 108/48; 108/38

[58] Field of Search ..... 108/48, 80, 81, 38; 16/362

[56] References Cited

U.S. PATENT DOCUMENTS

| | | | |
|---|---|---|---|
| 817,596 | 4/1906 | Sirbenthal | 108/48 |
| 1,524,415 | 1/1925 | Uphus | 108/38 |
| 1,553,047 | 9/1925 | Kroschel | 108/38 |
| 1,699,766 | 1/1929 | Starr et al. | 108/48 |
| 1,765,168 | 6/1930 | Laursen | 108/38 |
| 2,307,753 | 1/1943 | Anderson | 16/362 X |
| 3,113,533 | 12/1963 | Snow | 108/81 X |
| 4,313,385 | 2/1982 | Fitzgerald | 108/38 |
| 4,437,414 | 3/1984 | Brescia et al. | 108/81 X |

FOREIGN PATENT DOCUMENTS

| | | | |
|---|---|---|---|
| 755640 | 8/1956 | United Kingdom | 108/81 |

*Primary Examiner*—Peter A. Aschenbrenner
*Attorney, Agent, or Firm*—Cooper & Dunham

[57] ABSTRACT

A folding table having a table board supported on and projecting outwardly from a wall in an open position, and foldable against the wall in such manner that the upper surface of the board faces outwardly from the wall and the support and mounting mechanism is entirely concealed. This mechanism includes a pair of parallel vertical tracks, slide elements that move along the tracks and are pivotally linked to the rear end of the board, and an articulated, pivotally mounted strut extending between the wall and the bottom surface of the board and foldable between the board and the wall. To open the table the rear end of the board, guided and supported by the tracks and slide elements, is moved vertically from an upper position to a lower position as the board pivots from a vertical to a horizontal orientation and the strut unfolds to support the board.

7 Claims, 3 Drawing Sheets

WALL-MOUNTABLE FOLDING TABLE

BACKGROUND OF THE INVENTION

This invention relates to folding tables which are arranged to be supported on and to project from a wall in a position for use, and which are capable of being folded against the wall in a storage position. More particularly, the invention relates to tables of the type described wherein the upper or use surface of the table faces outwardly from the wall when the table is folded. In one important specific aspect, to which detailed reference will be made below for purposes of illustration, the invention is directed to wall-mountable folding ironing boards.

In small apartments, it is often difficult to find space to store a conventional ironing board. Even in larger residences, it is inconvenient and annoying to have to remove a conventional ironing board from a storage closet, transport it to another locality for use, and thereafter return it to the closet. As is already known, these problems can be avoided or minimized by mounting a folding ironing board on a wall in such manner that it projects from and is supported by the wall when open, and lies more or less flat against the wall when stored, being manually movable between the open and stored positions.

A common disadvantage of known wall-mounted folding ironing board is that the mounting and support structure presents an unsightly appearance when the board is folded, especially if the underside of the board faces away from the wall in the folded position. Provision of a housing to conceal the structure adds to cost and derogates from desired compactness of the folded board. It is, indeed, also known to mount a folding ironing board or other table on a wall so that the upper surface of the table faces outwardly from the wall when folded, but the support mechanism in these known designs again requires concealment by a housing and/or is undesirably complex.

SUMMARY OF THE INVENTION

An object of the present invention is to provide a new and improved wall-mountable folding table, for example an ironing board, wherein the upper table surface faces away from the wall when folded, characterized by a mounting and support structure which is advantageously simple and easy to operate, and which affords highly stable, strong and safe support of the table in open position. Another object is to provide such a table wherein the mounting and support structure is fully concealed by the table itself in the folded position.

To these and other ends, the invention broadly contemplates the provision of a folding table mountable on a wall, comprising a table board having a top surface, a bottom surface, a rear end, and a front end; slide means, pivotally connected to the rear end of the board, for mounting the board on a wall for sliding vertical movement between an upper position at which the board, depends vertically from the slide means with the top surface facing outwardly and a lower position at which the board projects horizontally from the slide means with the top surface facing upwardly; and articulated strut means, having a rear end pivotally mountable on the wall beneath the aforesaid lower position and a front end pivotally connected to the board beneath the bottom surface of the board, for cooperating with the slide means to support the board stably in its lower position, the strut means being foldable between the board and the wall when the board is in the upper position so as to be concealed by the board.

Further in accordance with the invention, the slide means can comprise a pair of horizontally spaced slide elements, a pair of parallel vertical tracks mountable on the wall and respectively receiving the slide elements for guided vertical sliding movement, and means for respectively pivotally connecting the slide elements to the rear end of the board at points spaced transversely of the front-to-rear dimension of the board. Advantageously, the tracks are positioned to be completely enclosed between the board and the wall, when the board is in its upper position, so as to be concealed by the board.

In currently preferred embodiments, the connecting means comprises an axially horizontal shaft rotatably carried by the board beneath the bottom surface of the board, and a pair of obtusely angled V-shaped brackets fixedly mounted on and extending downwardly and rearwardly from the shaft; and the slide elements are rollers, respectively pivotally mounted on the brackets for rotation about a common horizontal axis parallel to the shaft. The tracks can be channel members, opening away from each other, into which the rollers respectively project.

Additionally, the slide means includes upper and lower stop means, associated with the tracks, for respectively limiting vertical travel of the slide elements at upper and lower elevations respectively corresponding to the upper and lower positions of the board, the lower stop means being in load-bearing engagement with the slide elements when the board is in its lower position, for supporting the rear end of the board in the lower position. In an especially preferred construction, frame elements interconnect the tracks to constitute therewith a rigid frame structure mountable on the wall and configured to be fully concealed between the board and the wall when the board is in its upper position; and this frame has a lower portion, to which the rear end of the strut means is pivotally connected, for pivotally mounting the rear end of the strut means on the wall.

As a still further particular feature of the invention, the strut means can comprise a rear strut arm having a rear end pivotally mountable on the wall, and a front end; and a front strut arm having a front end pivotally connected to the board beneath the bottom surface of the board and a rear end pivotally connected to the rear strut arm at a locality adjacent the front end of the rear strut arm, such that the front and rear strut arms are relatively movable between an extended configuration in which the strut means supports the board stably in the lower position, and a folded configuration. The rear strut arm includes a detent portion for overlying and bearing downwardly against the front strut arm when the arms are in the extended configuration to prevent relative pivotal movement of the arms beyond the extended configuration in a direction away from the folded configuration. The end and intermediate strut pivots are so oriented that when the rollers contact the upper stop there is an overcenter action of the folded strut which causes the board to be firmly retained in the vertical position against the wall frame. To provide fully stable support of the board in both the upper and the lower position the pivotal connections of the rear end of the rear strut arm, the front end of the front strut arm, and the rear end of the front strut arm, are relatively disposed so that in the extended configuration the pivotal connection of the rear end of the front strut arm lies below a straight line defined by the pivotal connections of the rear end of the rear strut arm and the front end of the front strut arm, and in the folded configuration, the pivotal connection of the rear end of the front strut arm is disposed rearwardly of a vertical line containing the pivotal connection of the rear end of the rear strut arm.

For safety in preventing excessive downward tilting of the board as it approaches or leaves its lower position, the front end of the rear strut arm can include a portion projecting forwardly of the locality at which the rear end of the front strut arm is pivotally connected thereto, this portion of the rear strut arm being arranged to bear against the bottom surface of the board, at a position of the board intermediate its upper and lower positions, to limit downward tilting of the front end of the board until the board is raised above the aforesaid intermediate position.

In the table of the invention, the described combination of strut means and slide means provides a structurally simple, easily manipulable, safe, and stable support and mounting for the board, and is at the same time completely concealed by the board when in the upper or folded position, presenting an aesthetically pleasing appearance with minimal space requirements. The board can be shaped and constructed for use as an ironing board, one particularly beneficial application of the invention being to provide a convenient and easily stored folding ironing board requiring no closet space for storage or open floor area for use, since it is at all times entirely supported on the wall on which it is mounted; however, the invention may also be embodied in other types of wall-mounted folding tables, e.g. work tables, dining tables, etc., utilizing a table board appropriately shaped for the intended purpose.

Further features and advantages of the invention will be apparent from the detailed description hereinbelow set forth together with the accompanying drawings.

DETAILED DESCRIPTION

Figure 2:
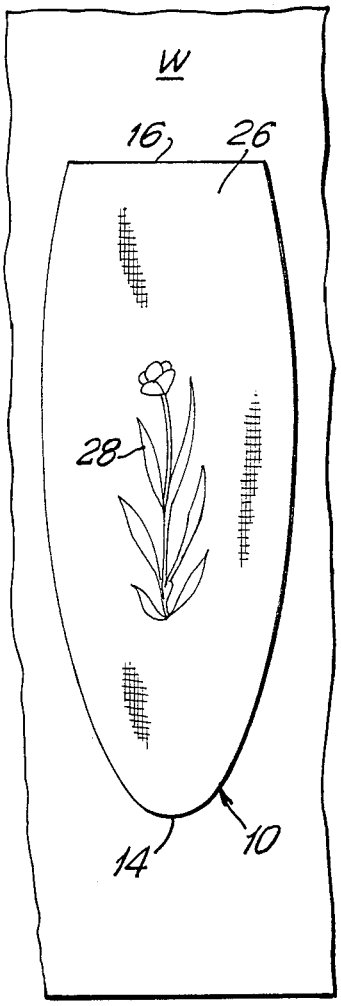
FIG. 2 is a front elevational view of the board of FIG. 1, in folded position.

The embodiment of the invention illustrated in the drawings is a folding ironing board including a rigid table top or board 10, a rigid unitary metal frame 11 mountable on a wall, and an articulated metal strut 12 extending between the lower end of the frame 11 and the bottom surface of the board 10. In this embodiment, the board 10 (which may, for example, be fabricated of metal) has a conventional ironing board configuration, with a tapered front end 14, a straight rear end 16, a planar top surface 18, and a bottom surface 28 completely laterally surrounded by a depending flange 22 and crossed by plural stiffening members 24 which extend between opposed side portions of the flange 22. A cloth or other cover 26 (FIG. 2), e.g. bearing a decorative design 28, may be secured to the board so as to extend over the top surface 18.

The frame 11 comprises a straight, horizontal top member 30, two track members 32 and 34 which respectively extend vertically downward from opposite ends of the top member and are bowed symmetrically toward each other in their lower portions, and a bottom bracket 36 to which the lower extremities of the track members are secured, bracket 36 being vertically aligned with the center of the top member. Conveniently, the track members may be welded to the top member and to the bracket 36 to provide the desired rigid and unitary frame structure. The frame is fastened to a planar vertical wall W-by screws or the like (not shown) respectively extending through a centered hole 38 in the top member and through a notch 40 in the bottom bracket, the screws or other fastening elements being selected and installed so as to support the full load of the ironing board on the wall; as thus mounted, the frame lies flat against the wall, in the above-indicated orientation, i.e. with the member 30 horizontal and disposed at the top. It will be understood that the provision of notch 40 facilities mounting of the frame on the wall; a fastener is first secured to the wall in position to be received in notch 40, and, with the frame supported by this fastener, the second fastener is inserted through the hole 38. The shape of the frame may conform generally to the outline of the board 10, but its dimensions in all directions are smaller than the corresponding dimensions of the area surrounded by the flange 22, such that the board can completely conceal the frame when disposed in overlying relation thereto, as hereinafter further explained.

The two track members 32 and 34 are channel members opening away from each other. Above their bowed lower portions, they constitute a pair of parallel vertical tracks respectively receiving a pair of slide elements, viz. low-friction plastic rollers 42 and 44 which respectively project into the channels of the tracks from opposite sides of the frame and are respectively pivotally mounted on links or brackets 46 and 48 for rotation about a common horizontal axis. The brackets 46 and 48, in turn, are pivotally connected to the rear end of the board 10, for permitting relative rotation of the brackets and board about a horizontal axis parallel to the axis of rotation of the rollers. More particularly, each of the brackets 46 and 48 is a flat metal member having a rearward arm and a forward arm forming an obtuse-angled V; the rollers are carried by the rearward arms of these brackets, while the forward arms are both secured to a horizontal shaft 50 pivotally mounted (for rotation about its horizontal axis.) by means of brackets 51 on the board 10 beneath the bottom surface 20 adjacent the rear end of the board but forwardly of the rear end portion 22*a* of the flange 22. The brackets 46 and 48 thus project forwardly from the rollers to the board, and upwardly to the shaft 50, in parallel and fixed relation to each other, respectively adjacent opposite sides of the board.

In this arrangement of elements, the tracks and rollers together with the brackets 46 and 48 and the shaft 50 cooperatively serve as slide means for mounting the board on a wall for sliding vertical movement of the rear end of the board between an upper position (FIG. 5) at which the board depends vertically from the slide means with its top surface 18 facing forwardly (outwardly from the wall) and a lower position (FIG. 8) at which the board projects horizontally from the wall with its top surface facing upwardly. During this movement of the board, the tracks guide the rollers for rolling vertical movement between upper and lower elevations respectively corresponding to the upper and lower positions of the board; the rolling action of the rollers minimizes frictional resistance to such movement of the rear end of the board, which is herein termed sliding movement because it could also be provided by non-rotatable slide elements (instead of rollers) moving along the tracks. Upward movement of the rollers is arrested at the aforementioned upper elevation by upper stop means 52 comprising end portions of the frame top member 30 that are engaged by the rollers when the rollers reach the top ends of the tracks. Downward movement of the rollers is arrested at the lower elevation by lower stop means comprising plastic blocks 54 mounted in the tracks such that the rollers bear against these blocks when the board reaches its lower position. The pivotal interconnections between the brackets 46, 48 and the board and the rollers permit the board to be rotated between its vertically depending orientation at the upper position and its horizontally projecting orientation at the lower position, i.e., as the rear end of the board is moved vertically between these positions.

Figure 3:
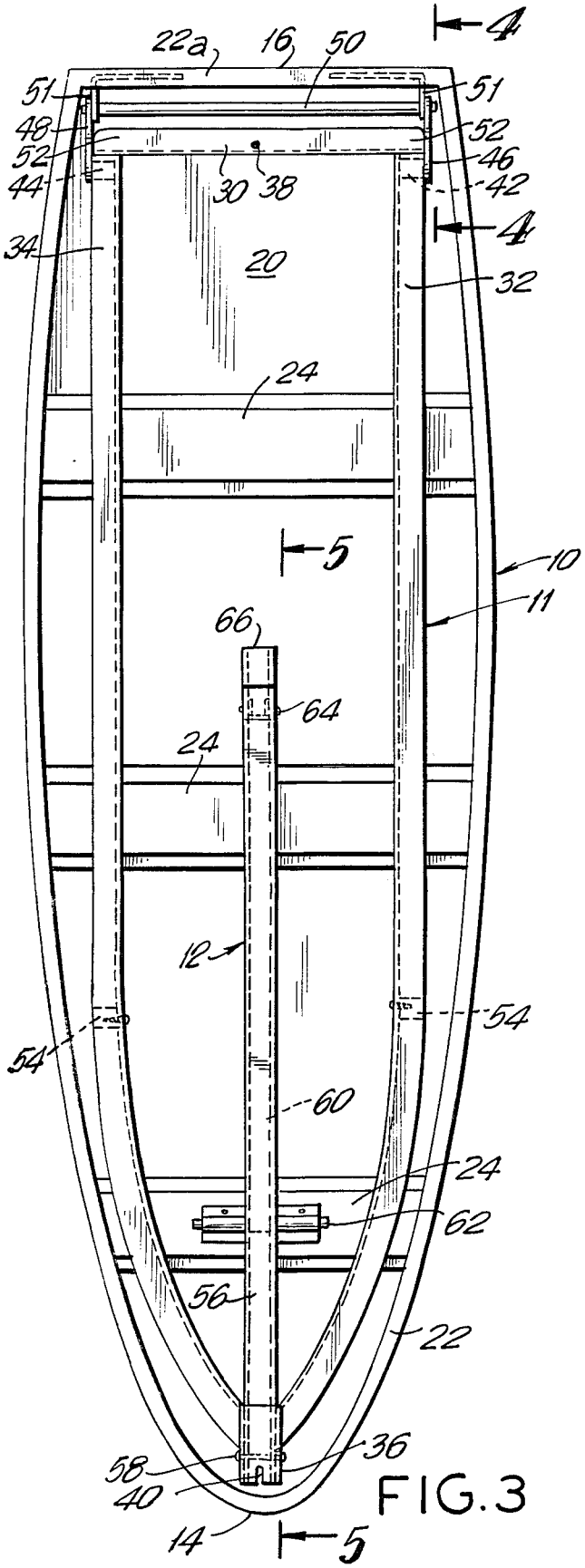
FIG. 3 is an enlarged rear elevational view of the board in folded position.
Figure 4:
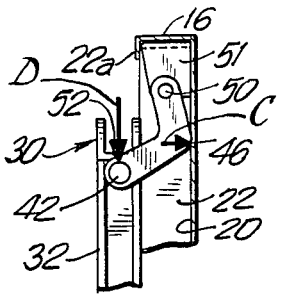
FIG. 4 is a further enlarged, fragmentary side view of the board in folded position, taken along the line 4—4 of FIG. 3.
Figure 8:
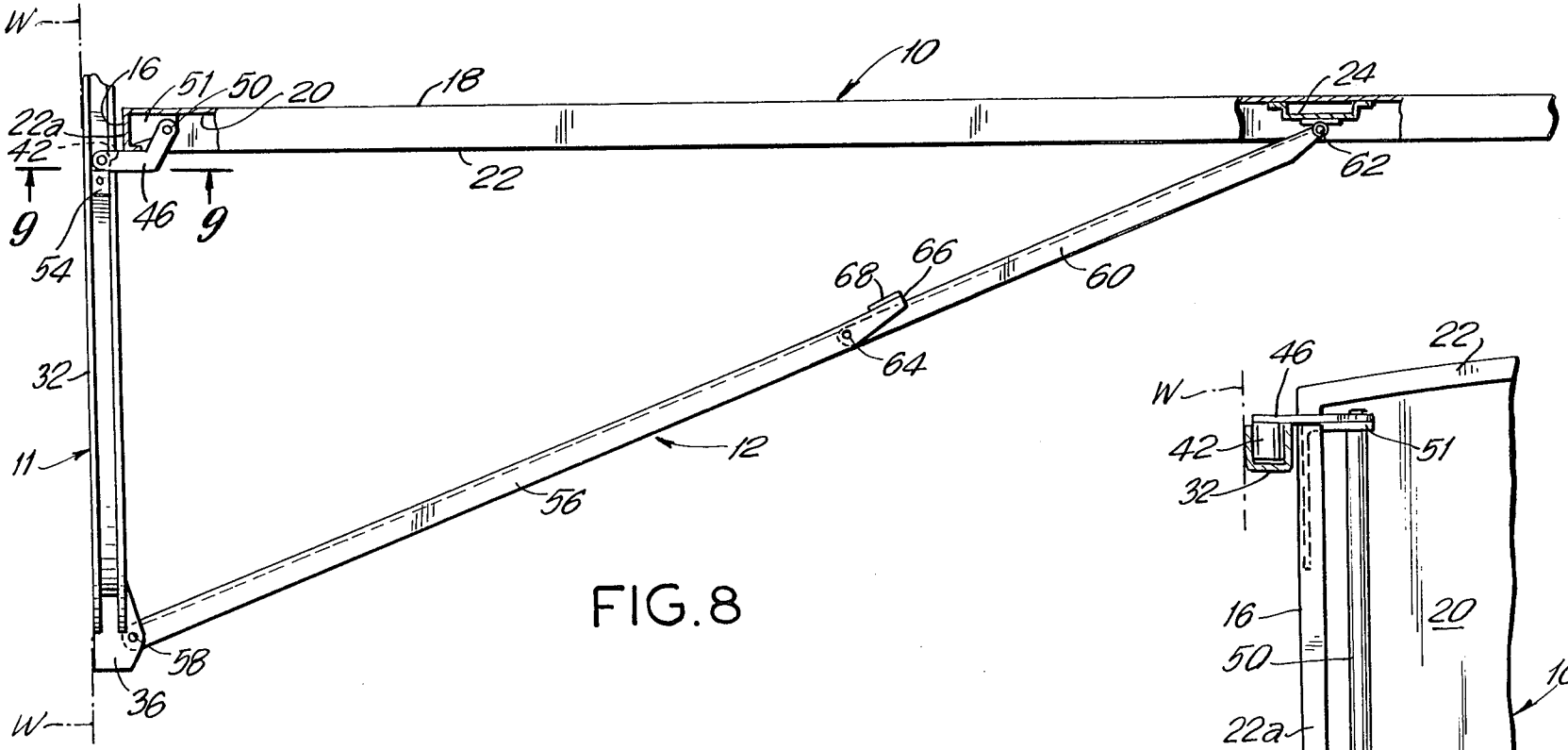
FIG. 8 is a side elevational view of the board in open position, on the same scale as FIG. 3, and partially broken away.

When the board is at the lower position and rotated to its horizontally projecting orientation, as shown in FIG. 8, the brackets 46 and 48 are oriented with their rearward arms projecting horizontally forward from the rollers while the forward arms of the brackets extend upwardly and forwardly, and the rear end portion 22*a* of the flange 22 bears against the horizontal upper edges of the rearward arms of the brackets; hence the load of the rear end portion of the board is transmitted through the bracket arms and rollers to, and supported by, the stop blocks 54, which are accordingly designed and mounted to carry this load. As the board is moved upwardly to the upper position and rotated to its vertically depending orientation the brackets 46 and 48 are rotated counterclockwise to the position shown in FIG. 4, in which their rearward arms project forwardly and upwardly, their forward arms project upwardly and rearwardly, and the apex of the V of each bracket bears against the bottom surface of the board. This latter orientation of the brackets causes the rear end of the board to approach the wall closely and to be elevated above the top member of the frame 11, while (as will be apparent from FIG. 3) the front end of the board extends below the bottom bracket 36 of the frame, so that the board completely conceals the frame as viewed from the front and is compactly stored against the wall as viewed from the side.

The strut 12 comprises a rear strut arm 56 having its rear end pivotally connected by a pin 58 to the frame bottom bracket 36 for rotation about a horizontal axis (parallel to the axis of rotation of the rollers 42 and 44) and a front strut arm 60 having its front end pivotally connected by a pin 62 to the board 10 beneath the bottom surface of the board. The rear end of the front arm 60 is pivotally connected to the rear arm 56, adjacent the front end of the rear arm, by a pin 64. The axes of strut arm rotation about pins 62 and 64 are both parallel to the axis of rotation of arm 56 about pin 58.

The pivotal interconnections of the strut arms with each other and with the bracket 36 and the board are such as to enable relative movement of the strut arms between an extended configuration (FIG. 8) in which the strut stably supports the forward portion of the board in the lower (horizontally projecting) position of the board, and a folded configuration (FIG. 5) in which the strut is folded between the board and the wall (with the board in its upper, vertically depending position) and is completely concealed by the board. In order to achieve stable support of the board in the lower position, the rear strut arm includes a detent portion for overlying and bearing downwardly against the front strut arm when the arms are in the extended configuration, for preventing relative pivotal movement of the arms beyond the extended or straight configuration in a direction away from the folded configuration, i.e. to limit clockwise rotation of arm 56 about pin 58 and counterclockwise rotation of arm 60 about pin 62, as seen in FIG. 8. In the illustrated embodiment, the front and rear arms are both downwardly opening channel members, so dimensioned that the rearward portion of the front arm is received within the channel of the rear arm; the web of the rear arm channel thus constitutes the aforementioned detent portion, bearing downwardly against the front arm to arrest relative rotation of the arms when the arms reach the extended configuration.

Figure 5:
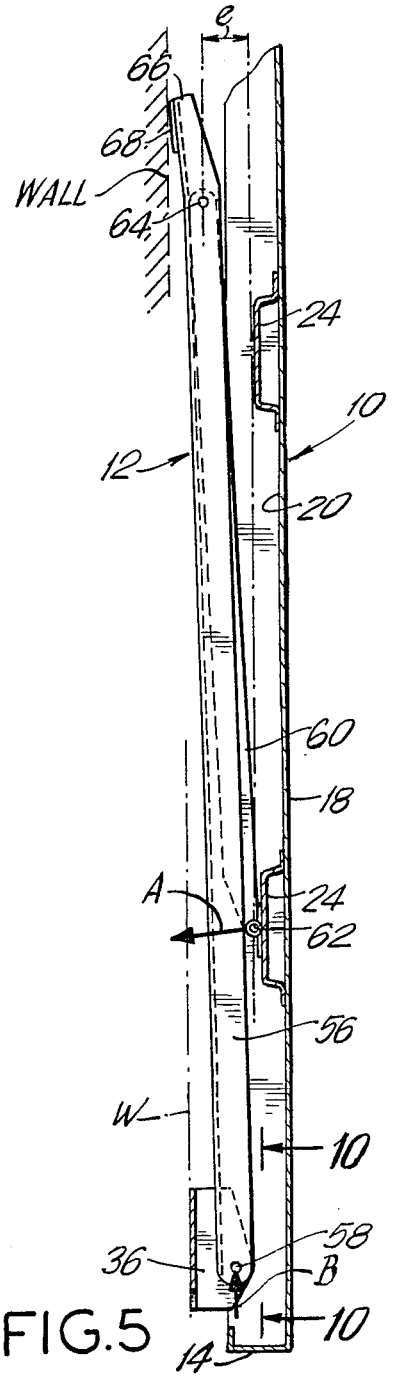
FIG. 5 is a fragmentary sectional view of the board in folded position, on the same scale as FIG. 4, taken along the line 5—5 of FIG. 3.

As further shown in FIG. 8, the pins 58, 62 and 64 are so disposed that in the extended configuration of the strut, the axis of rotation about pin 64 (interconnecting the strut arms) lies slightly below a straight line defined by the axes of rotation about pins 58 and 62. This overcentering relation of the pins prevents the extended strut from accidentally folding under load on the board. Also, as shown in FIG. 5, in the folded configuration of the strut, the axis of rotation about pin 64 is disposed rearwardly of a vertical line containing the axis of rotation about pin 58. Thus, the weight of the vertically depending board in the upper position, which is entirely transmitted through the folded strut to bracket 36, does not tend to open the strut or cause the board to descend to the lower position, and the board remains securely and stably in the upper position.

Figure 7:
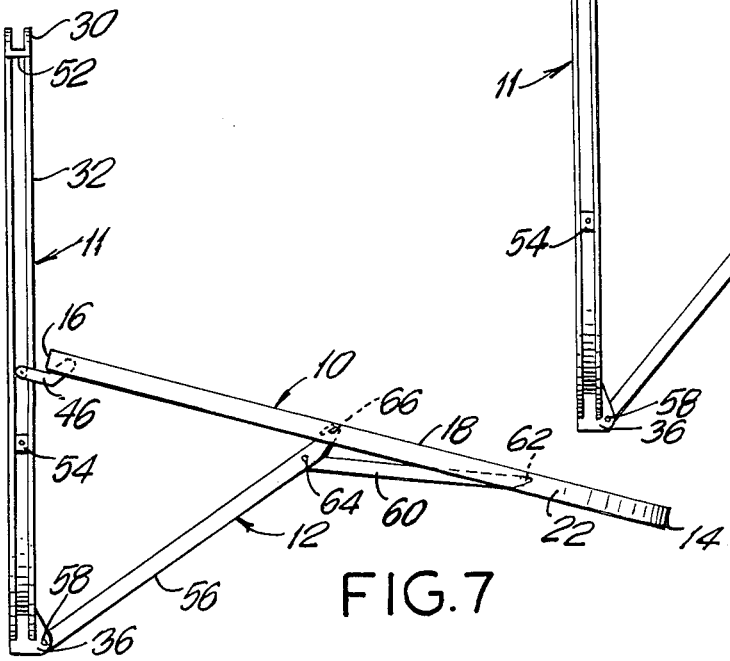

As an additional safety feature, the front end 66 of the rear strut arm 56 projects forwardly of pin 64 for a sufficient distance to bear against the bottom surface of the board, at a position (FIG. 7) of the board intermediate the upper and lower positions, so as to limit downward tilting of the front end of the board until the board is raised above the aforesaid intermediate position. A pad 68 may be mounted on the upper surface of arm end 66, to cushion the engagement of the latter arm and both with the board (in the FIG. 7 position) and with the wall W (in the folded position of FIG. 5).

The use and operation of the board may now be readily explained. With the frame 11 securely and fixedly mounted on a wall and the board in its upper or folded position (FIG. 2–5 and 10) the board is stably retained for storage by virtue of the distribution of forces acting on the folded strut. The board completely conceals the frame 11, strut 12 and all associated mounting and support elements, and its upper surface (preferably having a decorative cover) faces outwardly from the wall, presenting the attractive appearance of an ornamental wall hanging.

Figure 1:
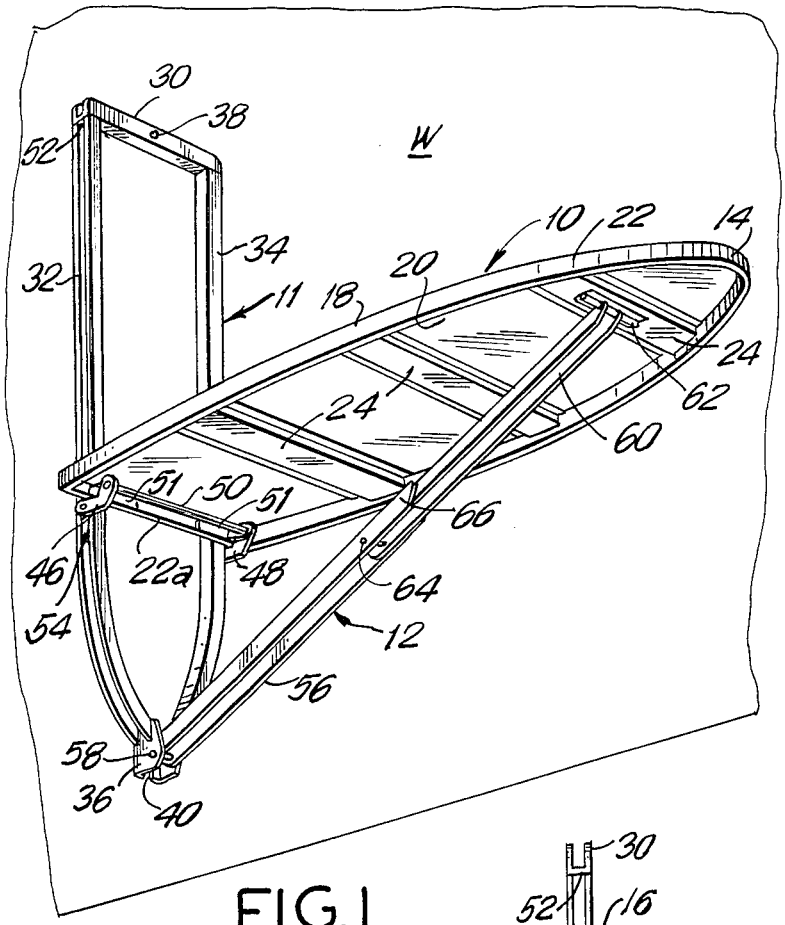
FIG. 1 is a perspective view, from below, of a folding ironing board embodying the present invention in a particular form, illustrating the board in open position for use.
Figure 6:
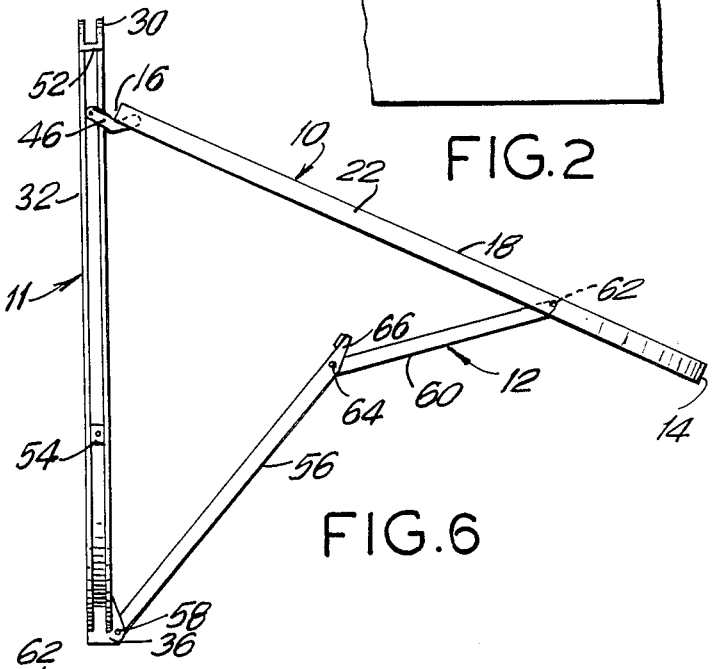
FIGS. 6 and 7 are side elevational views of the board, on the same scale as FIGS. 1 and 2, illustrating successive positions (intermediate the folded and open positions) assumed by the board as it moves from folded to open position.
Figure 9:
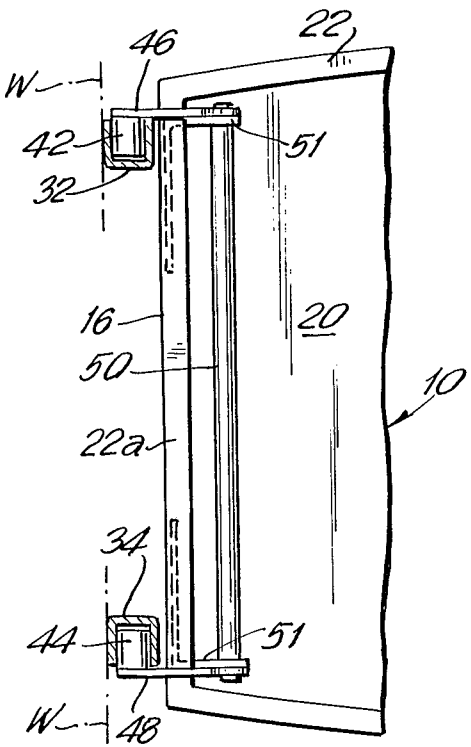
FIG. 9 is a still further enlarged fragmentary plan view, partly in section, taken along the line 9—9 of FIG. 8.
Figure 10:
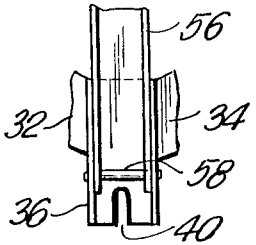
FIG. 10 is a fragmentary front elevational view, on the same scale as FIG. 9, taken along the line 10—10 of FIG. 5.

To move the board to its lower or open position for use, the user grasps the front end of the board with one hand or two hands and pivots it outwardly and upwardly away from the wall, while exerting a moderate downward rotational force on the rear portion of the board with the other hand, causing the strut to begin to unfold and at the same time causing the rear end of the board to begin to descend, by the guided sliding movement provided by the tracks and rollers. As the strut opens, the weight of the board promotes this descent, through the position shown in FIG. 6 to that shown in FIG. 7. Further manual upward rotation of the front end of the board, and continued manual downward pressure on the rear portion of the board, carries the board through the FIG. 7 position to the fully open position of FIGS. 1, 8 and 9, in which the upper surface of the board has rotated through 90° from a vertical, outwardly facing orientation to a horizontal, upwardly facing orientation and the rear end of the board has descended to the lower position. The weight of the board, and any load thereon, is now stably distributed among the strut and the two lower stop blocks 54 which support the rear of the board. A moderate manual downward pressure may be briefly exerted on the strut (at about the locality of pin 64) to confirm that the strut has reached its over-centered, fully extended configuration. The board is then ready for ironing or other load supporting use.

To return the board to the folded position, the above-described sequence of manipulations is essentially reversed. Using two hands placed at points on either side of the frame at a distance slightly above the center of gravity and with a lifting and rotating motion, the strut will jackknife and fold the board to the wall bracket.

It is to be understood that the invention is not limited to the features and embodiments hereinabove specifically set forth, but may be carried out in other ways without departure from its spirit.

I claim:

1. A folding table mountable on a wall, comprising:

(a) a table board having a top surface, a bottom surface, a rear end, and a front end;

(b) slide means, pivotally connected to the rear end of the board, for mounting the board on a wall for sliding vertical movement between an upper position at which the board depends vertically from the slide means with said top surface facing outwardly and a lower position at which the board projects horizontally from the slide means with said top surface facing upwardly; and (c) articulated strut means, having a rear end pivotally mountable on the wall beneath said lower position and a front end pivotally connected to the board beneath said bottom surface, for cooperating with the slide means to support the board stably in said lower position, said strut means being foldable between the board and the wall when the board is in the upper position so as to be concealed by the board;

(d) said strut means comprising a rear strut arm having a rear end pivotally mountable on the wall, and a front end; and a front strut arm having a front end pivotally connected to the board beneath said bottom surface and a rear end pivotally connected to the rear strut arm at a locality adjacent the front end of the rear strut arm, such that the front and rear strut arms are relatively movable between an extended configuration in which the strut means supports the board stably in said lower position, and a folded configuration; said rear strut arm including a detent portion for overlying and bearing downwardly against the front strut arm when the arms are in the extended configuration to prevent relative pivotal movement of the arms beyond the extended configuration in a direction away from the folded configuration; the pivotal connections of the rear end of the rear strut arm, the front end of the front strut arm, and the rear end of the front strut arm, being relatively disposed so that in the extended configuration the pivotal connection of the rear end of the front strut arm lies below a straight line defined by the pivotal connections of the rear end of the rear strut arm and the front end of the front strut arm, and in the folded configuration, the pivotal connection of the rear end of the front strut arm is disposed rearwardly of a vertical line containing the pivotal connection of the front end of the front strut arm;

(e) said slide means comprising a pair of horizontally spaced slide elements, a pair of parallel vertical tracks mountable on the wall and respectively receiving the slide elements for guided vertical sliding movement, upper stop means associated with said tracks for engaging said slide elements at an upper elevation corresponding to said upper position of said board to arrest upward motion of said slide elements, and means for respectively pivotally connecting the slide elements to the rear end of the board at points spaced transversely of the front-to-rear dimension of the board, the spacing between the tracks being less than the width of the board, and the tracks being positioned to be completely enclosed between said board and the wall, when said board is in said upper position, so as to be concealed by the board; and (f) said connecting means comprising an axially horizontal shaft rotatably carried by the board beneath said bottom surface, and a pair of obtusely angled V-shaped brackets fixedly mounted on and extending downwardly and rearwardly from said shaft and respectively pivotally connected to said slide elements for rotation relative thereto about a common horizontal axis parallel to said shaft, said brackets having apices, intermediate said shaft and said slide elements, disposed to engage said bottom surface of said board when said board is in said upper position.

2. A table as defined in claim 1, wherein said slide elements are rollers, respectively pivotally mounted on said brackets for rotation about a common horizontal axis parallel to said shaft.

3. A table as defined in claim 2 wherein said tracks are channel members, opening away from each other, into which said rollers respectively project.

4. A table as defined in claim 1 wherein said slide means further includes lower stop means, associated with said tracks, for limiting vertical travel of said slide elements at a lower elevation corresponding to said lower positions of said board, said lower stop means being in load-bearing engagement with said slide elements when said board is in said lower position for supporting the rear end of the board in said lower position.

5. A table as defined in claim 1 further including frame elements interconnecting said tracks to constitute therewith a rigid frame structure mountable on the wall and configured to be fully concealed between the board and the wall when the board is in its upper position; and wherein the frame has a lower portion, to where the rear end of the strut means is pivotally connected, for pivotally mounting said strut means rear end on the wall.

6. A table as defined in claim 1 wherein the front end of the rear strut arm projects forwardly of the locality at which the rear end of the front strut arm is pivotally connected thereto, and is arranged to bear against the bottom surface of the board, in a position of the board intermediate said upper and lower positions, to limit downward tilting of the front end of the board until the board is raised above said intermediate position.

7. A table as defined in claim 1 wherein said board is an ironing board.

* * * * *